US006352336B1

(12) United States Patent
Bisberg et al.

(10) Patent No.: US 6,352,336 B1
(45) Date of Patent: Mar. 5, 2002

(54) ELECTROSTATIC MECHNICALLY ACTUATED FLUID MICRO-METERING DEVICE

(75) Inventors: Jeffrey Elliott Bisberg; Jean-Marie Gutierrez, both of Southbury; Ronald E. Marusak; Hongsheng Zhang, both of New Milford, all of CT (US)

(73) Assignee: Illinois Tool Works INC, Glenview, IL (US)

( * ) Notice: Subject to any disclaimer, the term of this patent is extended or adjusted under 35 U.S.C. 154(b) by 0 days.

(21) Appl. No.: 09/632,939

(22) Filed: Aug. 4, 2000

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS

| | | | |
|---|---|---|---|
| 4,203,128 | A | 5/1980 | Guckel et al. |
| 4,312,008 | A | 1/1982 | Taub et al. |
| 4,520,375 | A | 5/1985 | Kroll |
| 4,536,097 | A | 8/1985 | Nilsson |
| 4,887,100 | A | 12/1989 | Michaelis et al. |
| 4,992,808 | A | 2/1991 | Bartky et al. |
| 5,016,028 | A | 5/1991 | Temple |
| 5,227,813 | A | 7/1993 | Pies et al. |
| 5,311,219 | A | 5/1994 | Ochiai et al. |
| 5,513,431 | A | 5/1996 | Ohno |
| 5,534,900 | A | 7/1996 | Ohno et al. |
| 5,543,009 | A | 8/1996 | Hayes |
| 5,554,247 | A | 9/1996 | Pies et al. |
| 5,563,634 | A | 10/1996 | Fujii et al. |
| 5,619,235 | A | 4/1997 | Suzuki |
| 5,631,680 | A | 5/1997 | Sugahara |
| 5,644,341 | A | 7/1997 | Fujii et al. |
| 5,666,144 | A | 9/1997 | Zhang |
| 5,668,579 | A | 9/1997 | Fujii et al. |
| 5,734,395 | A | 3/1998 | Kamisuki et al. |
| 5,818,473 | A | 10/1998 | Fjuii et al. |
| 5,821,951 | A | 10/1998 | Fujii et al. |
| 5,894,316 | A | 4/1999 | Sakai et al. |
| 5,912,684 | A | 6/1999 | Fjuii et al. |
| 5,975,668 | A | 11/1999 | Fjuii et al. |
| 5,980,027 | A | 11/1999 | Yoshimura |
| 5,992,978 | A | 11/1999 | Fjuii et al. |
| 6,000,785 | A | 12/1999 | Sakai et al. |

*Primary Examiner*—Raquel Yvette Gordon
(74) *Attorney, Agent, or Firm*—Lisa M. Soltis; Mark W. Croll; Donald J. Breh

(57) ABSTRACT

An electrostatic mechanically actuated micro-metering device having an array of fluid chambers with orifices for ejecting fluid is designed, such that the pitch of the chamber array is independent from length and height dimensions of the actuating membrane that comprises a chamber wall, resulting in a higher resolution without requiring a substantially exponential increase in the applied voltage.

24 Claims, 7 Drawing Sheets

ELECTROSTATIC MECHNICALLY ACTUATED FLUID MICRO-METERING DEVICE

TECHNICAL FIELD

The present invention relates to a fluid micro-metering device, and more particularly to an improved configuration for an electrostatic mechanically actuated fluid micro-metering device having an array of fluid chambers with orifices for metering fluid, that achieves a higher pitch density for the chamber array.

BACKGROUND OF THE INVENTION

Micro-metering of a fluid is useful in many applications and is especially important where fluid dosage is critical, for either functional or economic reasons. For example, an ingredient may be precisely metered in a production line to achieve a desired product quality, or an exotic material may be metered accurately to reduce cost.

One such application involves the micro-metering of ink from an impulse or drop-on-demand (DOD) ink jet printing device. Ink jet printing technology has revolutionized the office and home printer markets over the last two decades and is increasingly being used in industrial printing applications. Impulse Ink jet printing is performed by ejecting ink droplets from orifices or nozzles in the print head, such that the droplets travel to and are deposited on a substrate, forming a printed image. The print head associated with an ink jet printer typically comprises chambers aligned in an array, each chamber having at least one orifice for ejecting ink. Actuation devices associated with the chambers are energized and de-energized to create pressure changes in the chambers, resulting in the ejection of droplets of ink from the orifices.

For apparatus involving an array of fluid chambers, pitch is defined as the density of dots (or droplets of fluid) that are ejected from the array, expressed as drops per inch (DPI). The pitch of the array, e.g., print head, is directly related to how closely aligned the ink chambers of the linear array are. Thus, a print head having a high pitch translates into better printing resolution and clarity (greater DPI). High printing resolution is demanded by such applications as bar code printing, carton and letter labeling, business form printing, and higher resolution printing on substrates such as garments, packages and various parts.

Image formation can be controlled in impulse ink jet printers by selectively energizing and de-energizing actuators that change the pressure in the ink chamber, resulting in the ejection of ink through the orifices. One type of electromechanical actuator that has been used in ink jet printing is a piezoelectric transducer, for example, based on lead-zirconate-titanate. One class of piezoelectric print head design adheres the piezoelectric element to a wall of the chamber, so that the application of voltage to the piezoelectric causes distortion and deformation of the wall, thereby creating a pressure pulse in the chamber to eject the ink droplet. Another class involves utilizing the piezoelectric element itself as the chamber wall.

Piezoelectric elements, however, are brittle, and piezoelectric actuators often require precise machining to manufacture the actuators at the required dimensions. Another disadvantage is that many piezoelectric actuators need to be attached to a membrane with an adhesive or similar agent. Such machining and bonding processes require significant time and labor, and are subject to poor manufacturing tolerances. There is often an inherent limitation associated with machining capability, accuracy and tolerances concerning the manufacturing and construction of high pitched piezoelectric print heads. Further, piezoelectric actuators pose limitations in applications requiring higher resolution ink jet printing because piezoelectric transducers are prone to material defects and distortions introduced by manufacturing variability, which in turn leads to electromechanical inefficiencies. Consequently, the piezoelectric electromechanical impulse ink jet technology is limited in its ability to meet the demands of high0resolution imagining applications.

An example of such a piezoelectric actuated print head is disclosed in U.S. Pat. No. 5,227,813 (Pies et al.) showing a piezoelectric side wall actuated print head having a conductive surface adhered to and separating a first side wall section of an inactive material from a second side wall piezoelectric section, wherein the second side wall undergoes a shear-like motion to pull the first side wall section, thereby pressurizing the ink chamber.

In order to overcome some of the disadvantages associated with piezoelectric actuators, electrostatic mechanical actuators have also been used in impulse ink jet print heads. Such electrostatic actuators can comprise thin plates (also called diaphragms or membranes) formed adjacent to the ink chambers. In such an arrangement, a chamber wall that contains the ink can comprise a plate, which forms the actuator. When a time varying electric field is applied to an electrode in close proximity to the plate, the wall is deflected by the electrostatic force exerted between the plate and the electrode, producing a pressure disturbance in the chamber, thereby ejecting a drop of fluid from the chamber through an orifice.

For example, U.S. Pat. No. 4,520,375 (Kroll) discloses a fluid injector having a pair of capacitor plates spaced by an insulator, wherein a varying electric field between the plates sets a silicon membrane into mechanical motion causing fluid to eject through a nozzle.

U.S. Pat. No. 5,534,900 (Ohno et al.) discloses an electrostatically actuated ink jet print head having multiple layers and a plurality of nozzle openings communicating with independent injection chambers, wherein a membrane is positioned on a bottom wall of the injection chamber. In such a configuration, the driving voltage to actuate the membrane increases approximately exponentially as the pitch of the ink jet head is increased.

A disadvantage of prior art designs involving electrostatically actuated fluid jetting devices is that the membrane is orientated so that the pitch of the array is dependent upon the areal dimensions of the membrane (i.e., membrane length and width—not thickness). In other words, the membrane comprises the top or bottom chamber wall, or even the back wall opposed to the orifice plate. Such an orientation limits pitch, a critical dimension of the chamber array, in that the pitch decreases as the membrane width increases, deteriorating the resolution of the device. The applied or driving voltage required to actuate the membrane also increases approximately exponentially as the pitch of the fluid device is increased.

What is desired therefore is a configuration for an electrostatic mechanically activated micro-metering device that overcomes the above disadvantages.

SUMMARY OF THE INVENTION

Accordingly, it is an object of the present invention to provide an electrostatic mechanically actuated fluid micro-metering device, such as an impulse ink jet print head, that achieves a higher density pitch, without requiring a substantially exponential increase in the applied voltage.

Another object of the present invention is to provide an electrostatic mechanically actuated fluid micro-metering device, such as an impulse ink jet print head, including an array of chambers, wherein the width of each chamber is substantially independent from the areal dimensions of the electrostatic membrane provided within that chamber.

Another object of the present invention is to provide an electrostatic mechanically actuated fluid micro-metering device, such as an impulse ink jet print head, including an array of chambers, wherein the pitch of the array is substantially independent from the areal dimensions of the electrostatic membrane provided within each chamber, and wherein each chamber has a width as low as about 50 micron to achieve about a 300 DPI resolution, or preferably as low as about 25 microns to achieve about a 600 DPI resolution.

The present invention is an electrostatic mechanically actuated fluid micro-metering device, such as an impulse ink jet print head, having an electrostatically activated membrane that is oriented on a side wall of a fluid chamber and between adjacent chambers within a chamber array. This design eliminates the prior art inter-relationship and dependence between the areal dimension of the membrane and the pitch of the chamber array, so that higher resolution at moderate operating voltages may be achieved.

The present invention comprises: an electrostatic mechanically actuated fluid micro-metering device comprising an array of fluid chambers having a width (transverse axis); the array having a pitch substantially determined by the chamber width; wherein the chambers have one or more thin walls (or membranes) able to deform in the direction of a deformation axis, under the influence of an electrostatic force created by an electrical potential difference between such thin wall and an adjacent and closely spaced fixed electrode; the membrane deformation axes are substantially parallel to the transverse axes of the chambers.

The invention and its particular features will become more apparent from the following detailed description with reference to the accompanying drawings.

DETAILED DESCRIPTION OF THE INVENTION

Figure 1:
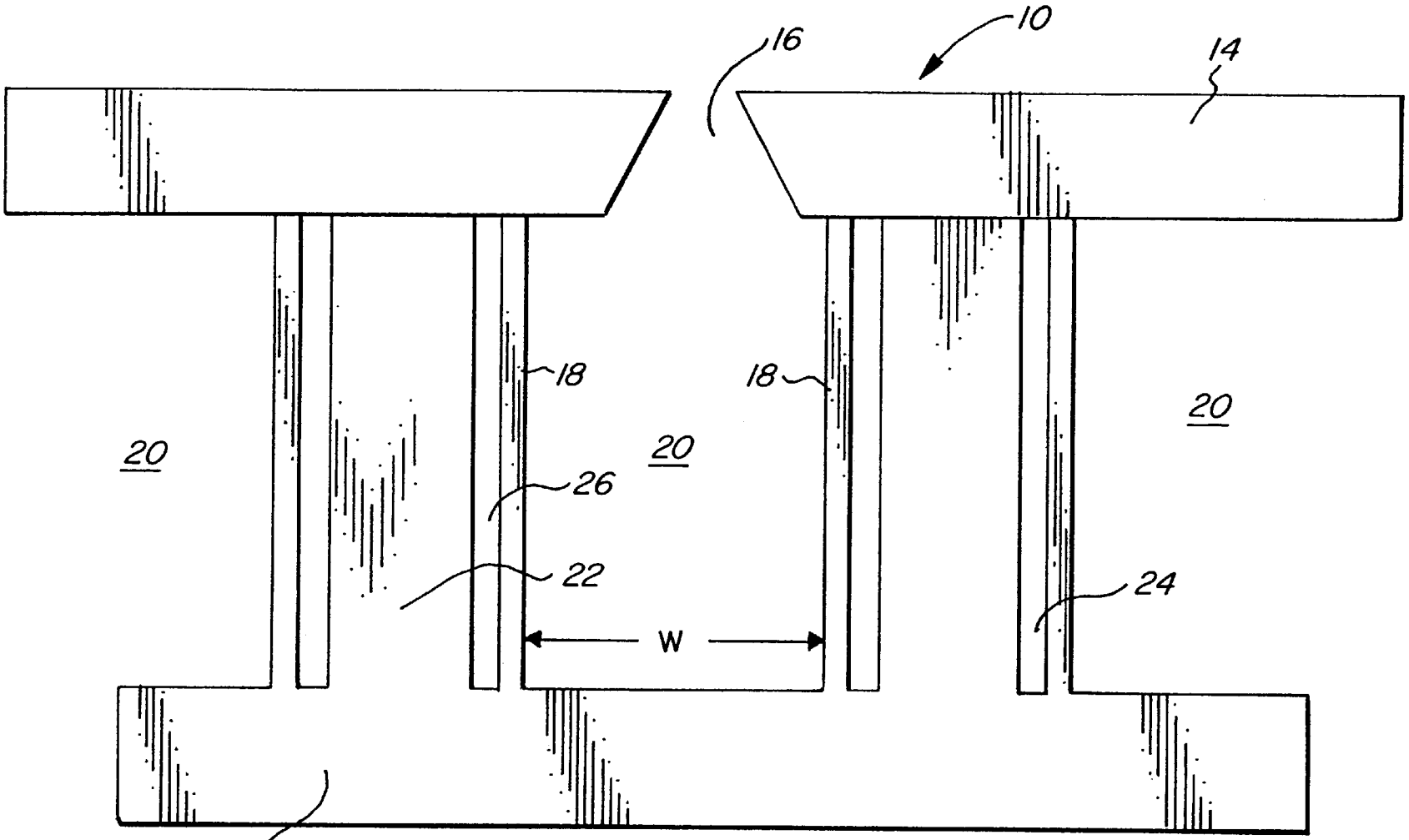
FIG. 1 is a representation of an electrostatic mechanically actuated fluid micro-metering device that is the subject of the invention.

FIG. 1 shows the present invention: an electrostatic mechanically actuated micro-metering device 10 having a base plate (or base substrate) 12, an orifice plate 14 with at least one orifice (or nozzle) 16, and chamber walls 18 extending from the base plate 12 to the orifice plate 16. The base plate 12, chamber walls 18 and orifice plate 14 define a fluid chamber 20 having a width w (transverse axis). A plurality of adjacent chambers 20 forms a chamber array, wherein the pitch of the array is determined by the width of the chambers. A base electrode 22 is spaced from and adjacent to each chamber wall 18 opposite the chamber 20, such that an electrostatic gap 24 exists between the chamber wall 18 and the base electrode 22. Each chamber wall 18 has a membrane electrode (or diaphragm electrode) 26 integral to the chamber 18 or formed thereon. Fluid is accurately ejected from the orifices 16 by selectively energizing and de-energizing an electric potential across base electrode 22 and the chamber wall membrane electrode 26, creating a pressure disturbance with chamber 20 that ultimately ejects fluid contained in the chambers 20 through the orifice 16.

Figure 2:
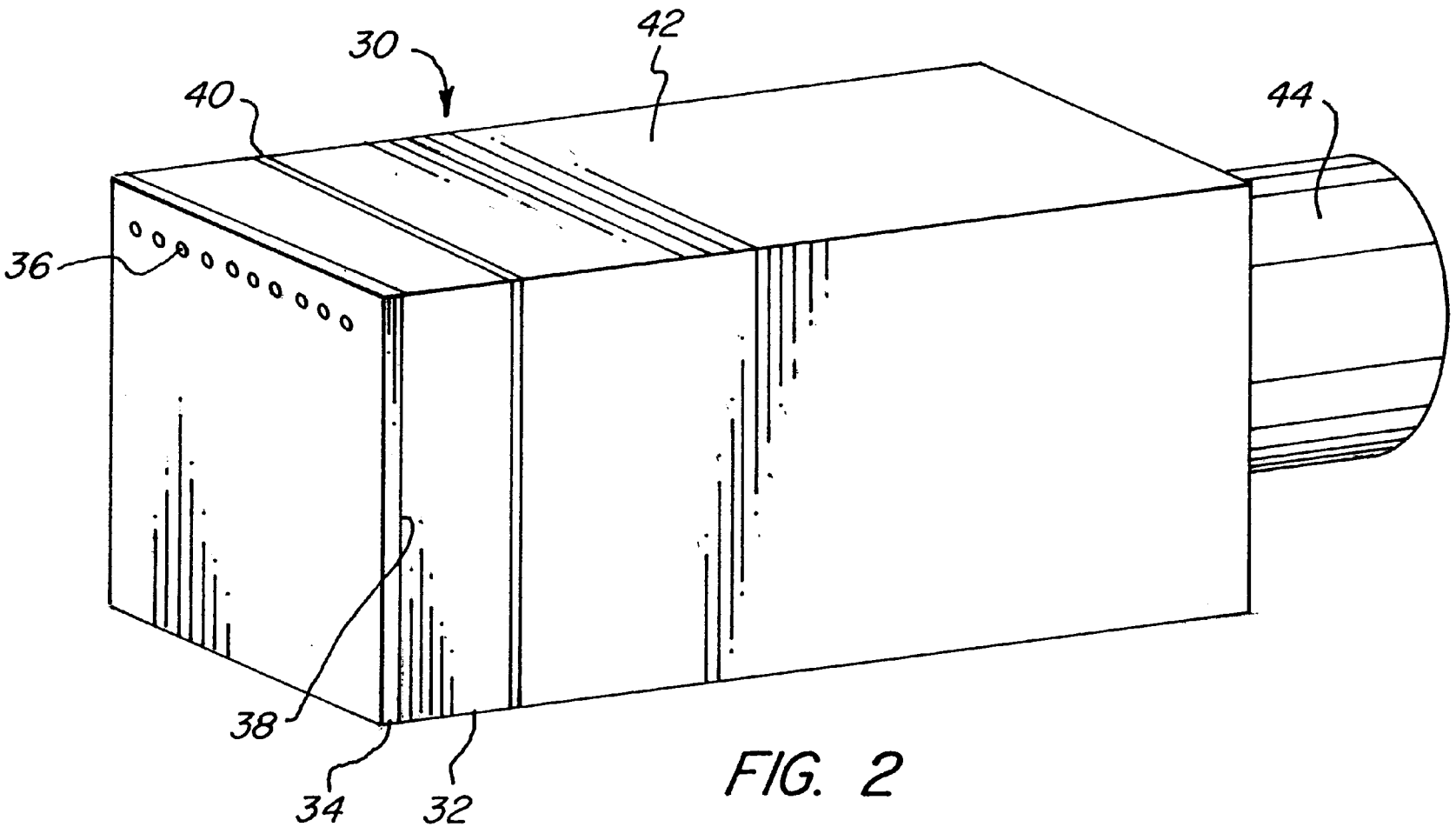
FIG. 2 is a representation of an electrostatic mechanically actuated ink jet print head assembly.

FIG. 2 depicts an embodiment of the electrostatic mechanically actuated fluid micro-metering device, such as an ink jet print head 30. The print head 30 generally includes a head assembly 32 having an orifice plate 34 with an array of orifices 36, which is bonded to front surface 38 of the head assembly 32. Filter 40 removes particles from the ink, and manifold 42 conducts the ink through an ink inlet 44 to the ink chambers.

Figure 3:
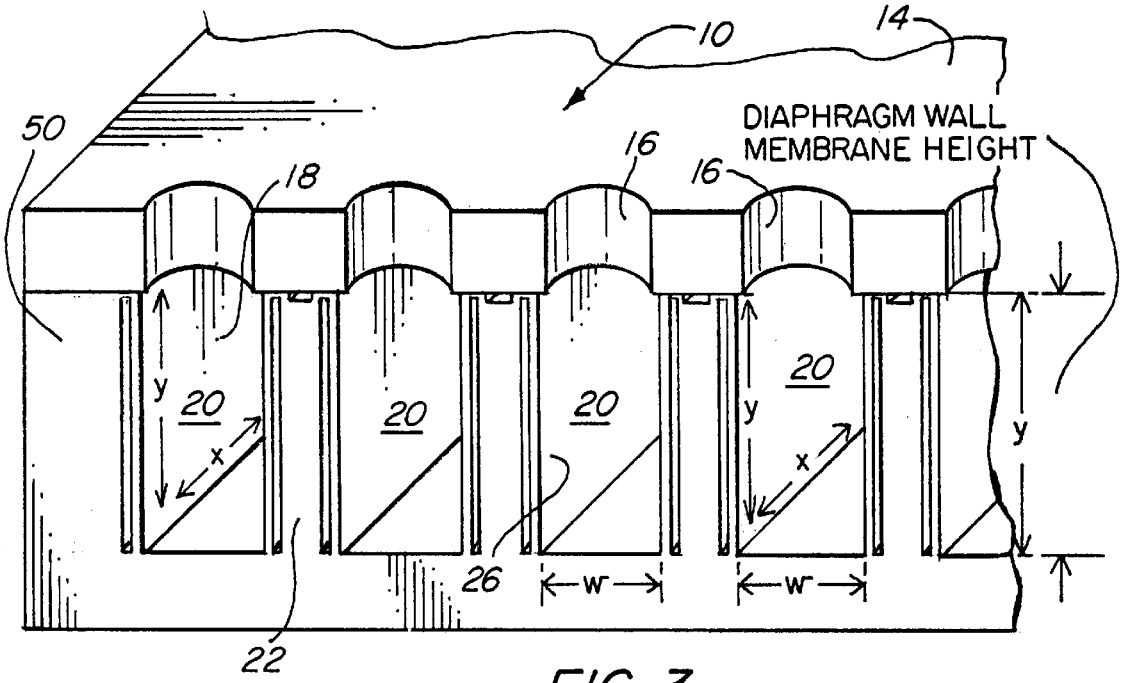
FIG. 3 is a sectional view of an embodiment of the electrostatic mechanically actuated micro-metering device of the present invention.

FIG. 3 shows a sectional view of the fluid micro-metering device depicted in FIG. 1, including an array of fluid chambers 20, each associated with an orifice 16. The side wall membrane electrodes 18 have a areal dimensions: length (x) and height (y). Preferably, the side wall membrane comprising a side wall of the chamber has a length in the range of between about 20 to about 2000 microns, and a height in the range of between about 20 to about 200 microns. The base electrodes 22 are separated from adjacent side wall membrane electrodes 18 by the electrostatic gap 24. Advantageously, the chambers 20 may be formed by etching a single base substrate material 50, such as silicon or quartz, and may be sealed by the orifice plate 14. The membrane electrodes 18 may be formed by depositing conformal thin-film coatings into trenches etched into the substrate.

Figure 6:
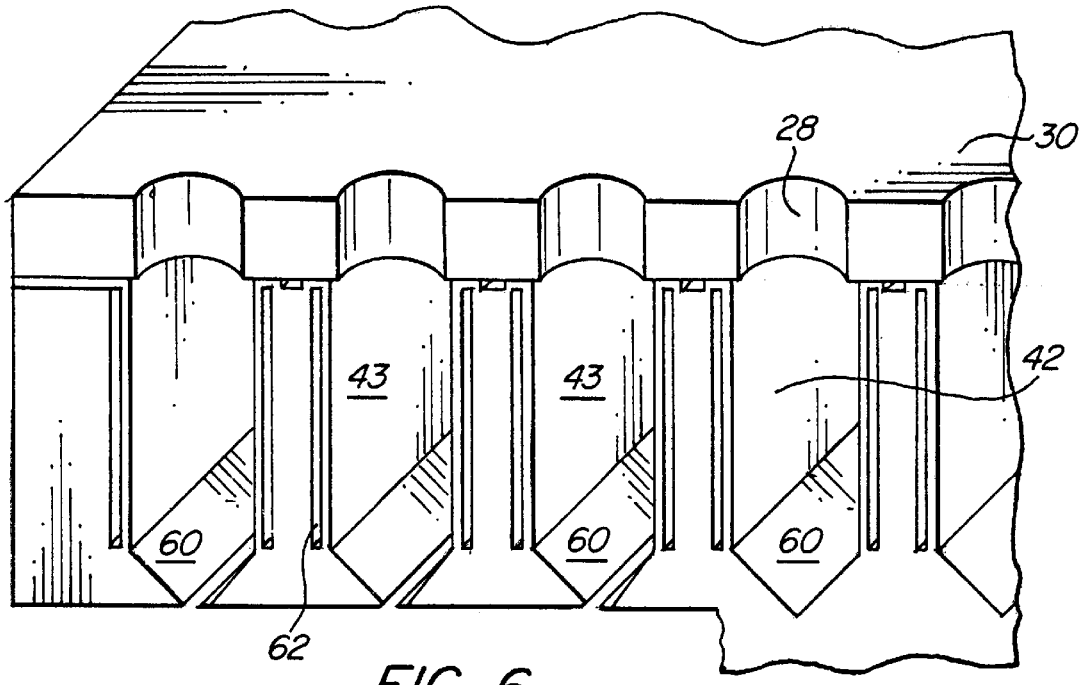
FIG. 6 is a sectional view of an embodiment of an electrostatic mechanically actuated micro-metering device of the present invention.

In FIG. 3, the orifices 16 are located in a top orifice plate 14, however, it is understood that the present invention is not limited to any particular orientation for the orifices, which may be situated in any suitable direction to achieve printing on a substrate. For example, the orifice may be located at the bottom of the fluid chamber or on the narrow end of the fluid chamber. This design, as compared to the designs known in the art, maximizes the flexibility in locating the orifices, enabling more compact designs, such as shown in FIG. 6, wherein a fluid refill path 60 located at the bottom of the chamber.

Accordingly, an array of fluid chambers is defined by a series of substantially parallel walls, wherein electrostatic gaps are formed between the chamber walls and the base electrodes. The aspect ratio of the walls (the ratio between the membrane length and the membrane height) is designed to maximize frequency of ejected droplets for a given drop volume. The pitch of the array is substantially independent from the areal (length and height) dimensions of the electrostatic membrane provided within each chamber. Preferably, each chamber width is as low as about 50 microns to achieve about a 300 DPI resolution, and more preferably as low as about 25 microns to achieve about a 600 DPI resolution.

Figure 4:
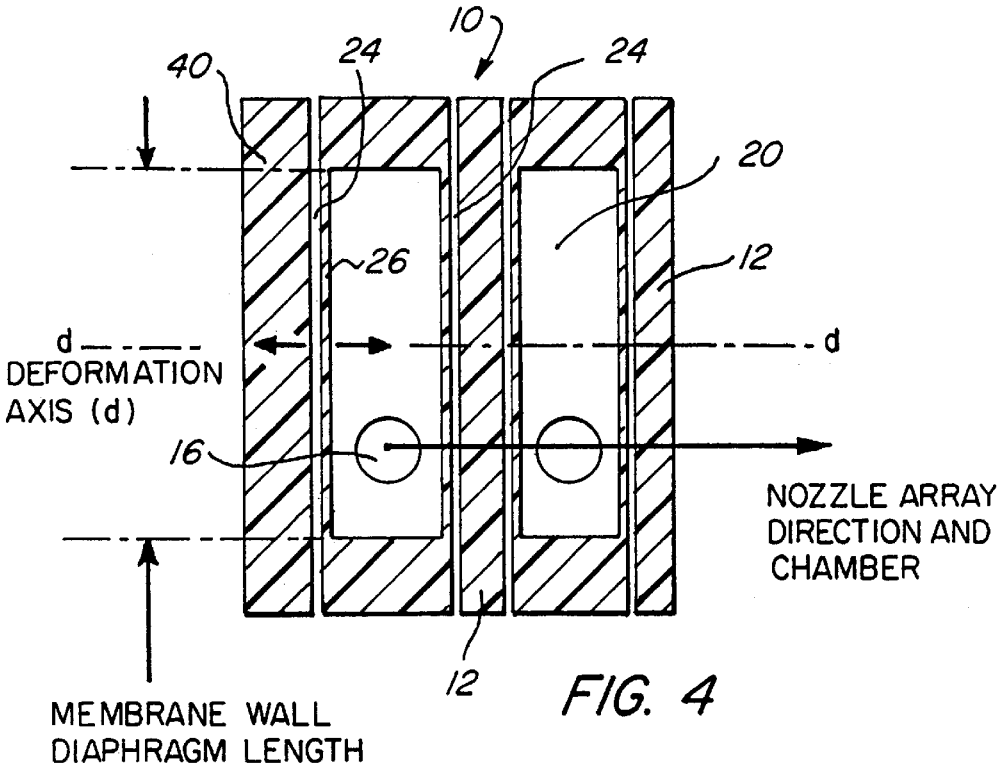
FIG. 4 is a top view of the embodiment shown in FIG. 3.

FIG. 4 shows a top view of the fluid micro-metering device depicted in FIGS. 1 and 3. In this embodiment, the membranes 26 deform along deformation axis d, which is substantially perpendicular to the direction of fluid ejection from the fluid chamber 20. In the context of impulse ink jet printers, whereby ink is discharged only when required, image formation can be controlled by selectively energizing and de-energizing an electric potential across the base electrode 22 and the membrane electrode 26, which in turn actuates walls 18 (via membranes 26 integral thereto) to create a pressure disturbance that ultimately ejects ink contained in the chambers 20 through orifice 16.

The present invention relies on electrostatic mechanical actuation of the chamber walls. This is achieved by various techniques known in the art, which rely principally on electrostatic forces created via supply of an electrical charge across a discharge gap. A capacitively coupled actuator is created between the membrane electrode and the base electrode. In the fabrication process, electrostatic gaps are formed between an electrostatically deforming membrane electrode material and a base electrode, forming the capacitor structure. When a voltage is applied across the gaps of the capacitor plates formed by the membrane electrode material and the base electrode, the resulting electrostatic force causes the base electrode 40 to attract walls toward it. Each wall preferably comprises a deforming membrane or membrane electrode material having a deformation axis d (FIG. 4). As a result, the chamber walls are deflected along the deformation axis d, producing a counter or restoring spring force when the membrane electrode material is discharged, thereby causing a pressure increase in the associated chamber after fluid has been drawn into the chamber through the manifold and fluid inlet of the print head assembly.

The membrane electrode may be any suitable material having the proper electrical conductivity for use as a capacitor plate, for example, such as doped polysilicon, doped silicon, aluminum, chrome, gold, molybdenum, palladium, platinum, Al—Si—Cu, or titanium, but is not necessarily limited to such materials. The material for the base electrode is preferably silicon or quartz but is not necessarily limited to such. The membrane electrode may be a composite of an insulator layer, a conductive layer, and insulator layer. The insulator material will have the proper electrical characteristics to be used with a chosen conductor material for the membrane electrode material (e.g., silicon nitride, silicon dioxide, aluminum oxide, indium oxide, tantalum oxide, tin oxide, or zinc oxide). Preferably, the membrane electrode and electrostatic gaps are sealed by a sealing layer of any one of the insulator materials described above, among others. The sealing layer seals the cavity or space between the electrostatic capacitor pair. The sealing layer is made of insulating material to prevent shorting of the electrodes.

A critical advantage of the present design is double-sided actuation, involving the actuation of two separate and distinct membranes of a single fluid chamber. Side wall actuation maximizes design flexibility by allowing other fluidic components to be positioned on any of the top, bottom, front, and back chamber walls. The chamber walls define a width w (transverse axis) and length l (longitudinal axis) for an array of fluid chambers. Double sided actuation provides better performance and enables the device to be smaller, thus allowing more devices to be fabricated for a given substrate area. The present invention also provides an electrostatically actuated micro-metering device having a more integrated and modular design, with less parts, than designs known in the art, thereby facilitating manufacture.

Figure 5A:
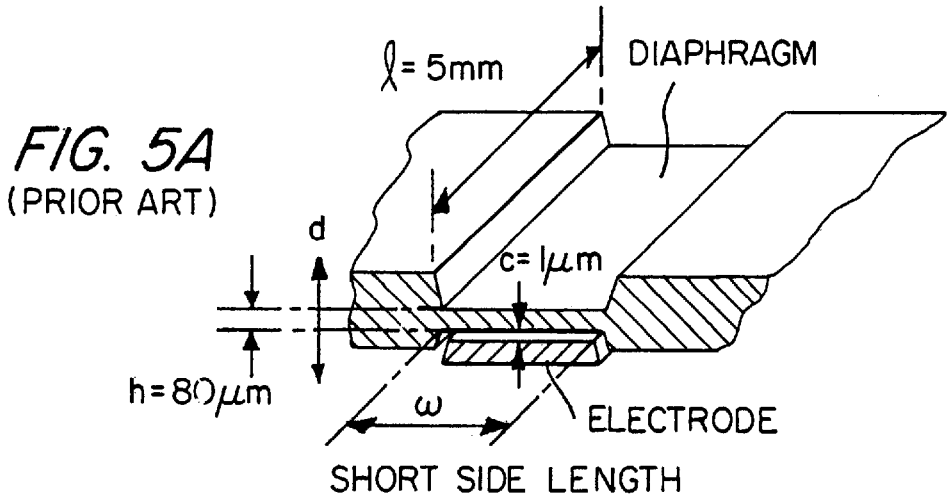
FIG. 5A (PRIOR ART)
FIGS. 5A and 5B show prior art designs for a membrane and electrode configuration of an electrostatic ink jet print head and the driving voltage of such configuration.
Figure 5B:
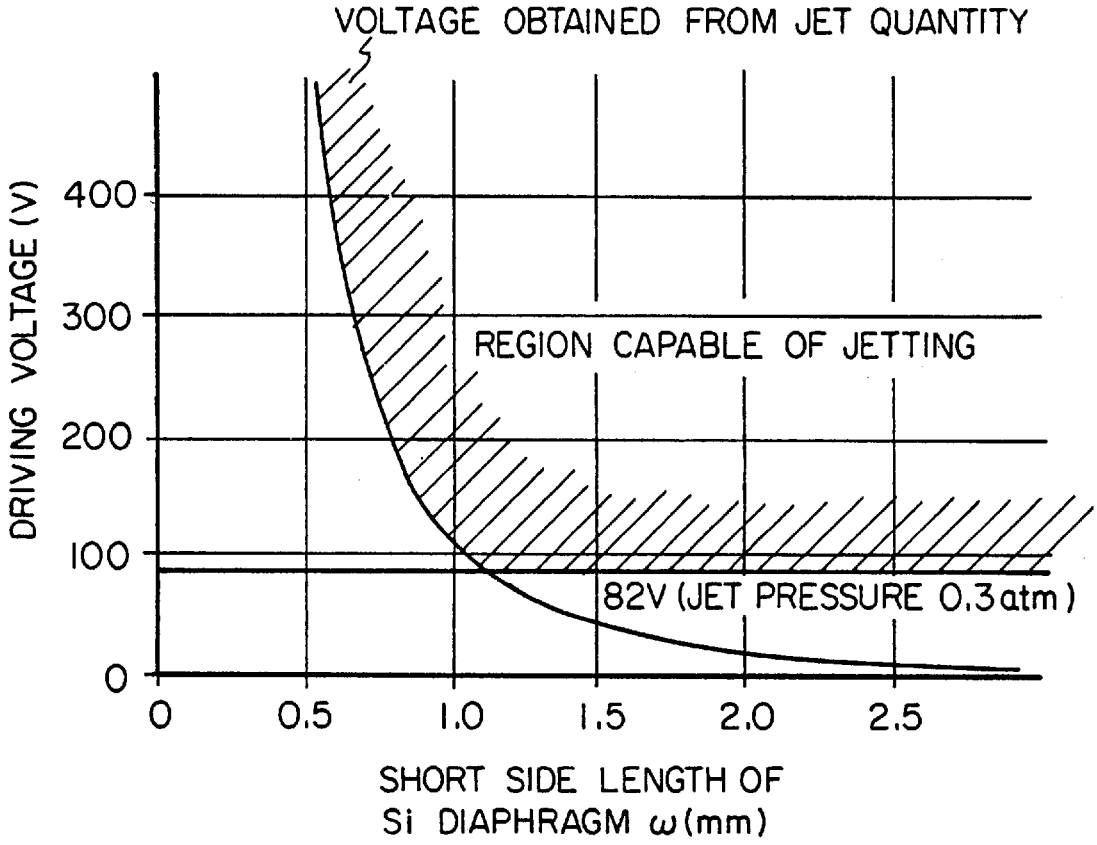
FIG. 5B (PRIOR ART)

Yet another advantage the present invention is an electrostatically actuated micro-metering device that achieves a high-density pitch relatively independent of the applied voltage required to actuate the membranes formed in the chambers. For example, FIGS. 5A and 5B show a prior art configuration for an electrostatically actuated ink jet print head, wherein an electrostatically deforming membrane is situated adjacent to an electrode such that the axis of deformation d associated with the membrane is perpendicular to the width w of the ink chamber bounded by the deforming membrane. Consequently, with such a configuration, as the pitch of the print head is increased, (requiring more ink droplets to be ejected per linear length of print head), the width of the ink chamber must be decreased. As a result, and as shown in FIG. 5B, the driving voltage required to effect a deformation of the membrane increases approximately exponentially as the width of the membrane, and in this case the width of the ink chamber associated therewith, is narrowed. However, with the configuration and design of the print head of the present invention, this limitation is removed because the electrostatically deforming membrane electrodes associated with walls such as 49A, 50A are situated with its deformation axis d substantially parallel to the width w of the ink chambers 42. Therefore, as a result of such a configuration, the pitch of the ink jet print head may be increased without requiring that the width of the deforming membranes or membranes be narrowed with the attendant increase in driving voltage required.

Preferably, the chamber wall comprising the membrane is in the range of between about 0.2 to about 20 microns thick, and the chamber has a width in the range of between about 10 to about 200 microns, a length in the range of between about 20 to about 2000 microns, and a height in the range of between about 20 to about 200 microns. The electrostatic gap is preferably in the range of between about 0.2 to about 5 microns wide, and the base electrode preferably has a thickness of less than about 5000 microns.

In alternate aspects of this invention, the structure for the electrostatic mechanically actuated fluid ejection device remains the same insofar as the deformation axis is substantially parallel to the width of the ink chambers, but the method of forming the membrane and the chamber wall may vary. For example, and not as a limitation to the present invention, some process variants can include subtractive technologies such as; 1) etching a single substrate with an anisotropic etch from one side to form both the chamber wall and the membrane; 2) anisotropically etching the chamber from one side of the substrate and the membrane from a second side of the same substrate; 3) anisotropically etching the chamber in a first substrate and the membrane in a second substrate and then joining the two substrates together; and 4) etching the membrane in a first substrate using anisotropic etches from both surfaces and the chamber wall in a second substrate, then joining the two substrates together.

In yet another aspect of the invention, the ink or fluid chamber 43 may be etched from the starting substrate to ultimately form an incline surface 60. As shown in FIG. 6, the incline surface 60 can have an angle greater than 90 degrees from the vertical plane of the membrane electrode 42 that forms substantially parallel walls of the ink chamber 43. One advantage of such a configuration for the ink or fluid chamber 43 is the fluid refill manifold can be located directly under the chamber thus minimizing the area of the device and maximizing the number of units per square inch. The incline surface 60 allows a cut to be made from the back side of the base substrate creating a narrow fluid refill path without compromising the seal of the electrostatic discharge gaps 62. This design is not possible when the chamber is configured having an actuator and/or electrostatic gap disposed at the chamber base.

Figure 7:
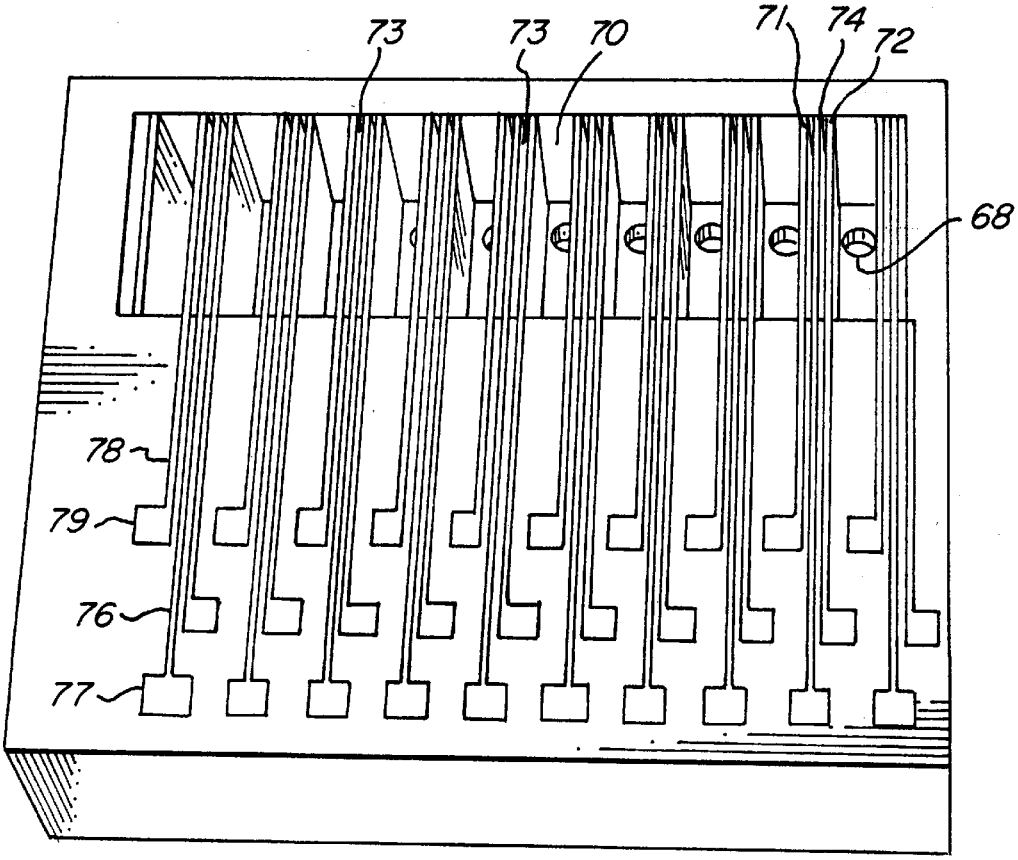
FIG. 7 is a top view of an embodiment of an electrostatic mechanically actuated fluid micro-metering device of the present invention.

FIG. 7 is a section view showing another example of a configuration for the electrostatic mechanically actuated fluid micro-metering device of the present invention. The device comprises an array of chambers 70, each associated with an orifice 68, wherein the chambers 70 are formed by a series of substantially parallel walls 71, 72, having a base electrode 74 interposed between each of the walls 71, 72. The base electrode 74 and the walls 71, 72 form electrostatically deforming membranes preferably constructed of a silicon or quartz substrate. Individual base electrodes 74 and the walls 71, 72 may be provided with corresponding leads 76, 78 and terminals 77, 79 and can be formed of the same conductor materials as previously described herein. The walls may be provided with corresponding leads and terminals formed of the same conductor materials. Driver chips may be surface mounted on the terminals 77, 79 to provide a driving voltage for the print head. When a voltage is applied across the gap 73 of the capacitor plates formed by the walls 71, 72 and base electrode 74, the resulting electrostatic force causes the base electrode 74 to attract the walls 71, 72 toward it. The walls 71, 72 are preferably made of a deforming membrane material such as silicon or quartz having a deformation axis d. As a result, the walls 71, 72 are deflected along the deformation axis d and produce a counter or restoring force when the capacitor plate is discharged, thereby causing a pressure increase in the associated chamber 70 after fluid has been drawn into the chamber through the manifold 20 and fluid inlet 22 of the device 10 shown in FIG. 1.

Preferably, although the present invention is not limited to such, the micro-metering device of the present invention may be integrally constructed from a single piece of starting material such as a block of semiconductor grade silicon or quartz. Preferably, the plurality of walls and membranes are substantially parallel and are created by an etching process known to those skilled in the art, such that the distance between walls and the base electrodes are minimized to maximize the electrostatic force. Although the device as shown in the FIGS. 1–10, show the chamber side walls having membranes at right angles to the base, the present invention is not limited to such a geometry and may include angles less than 90 degrees or greater than 90 degrees, while still having such walls formed of a electrostatically deforming membrane which is substantially parallel to the electrodes. In a limited set of designs these walls may be oriented at angles down to 45 degrees from the base. (The base is consistently grounded and does not provide for any actuation.)

Figure 8:
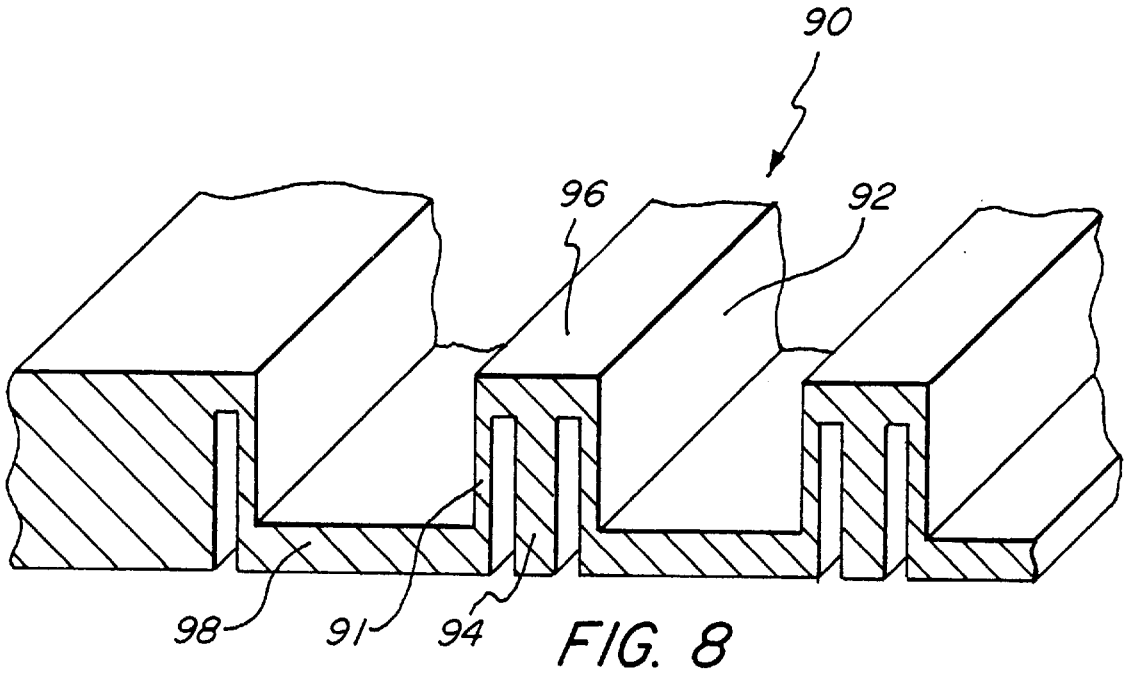
FIG. 8 is a side view of an embodiment of an electrostatic mechanically actuated fluid micro-metering device of the present invention, including a bridge that joins at least one pair of a plurality of chamber walls.

FIG. 8 shows a further embodiment of the invention, wherein the fluid micro-metering device 90 is configured to have a plurality of walls 91, 92 extending from a base 98, and wherein a structural material forms a bridge 96 joining at least one pair of the plurality of walls 91, 92. A plurality of electrodes 94 may extend from the bridge 96 and be constructed to actuate the walls 91, 92 bounding an ink chamber as previously set forth above.

Figure 9:
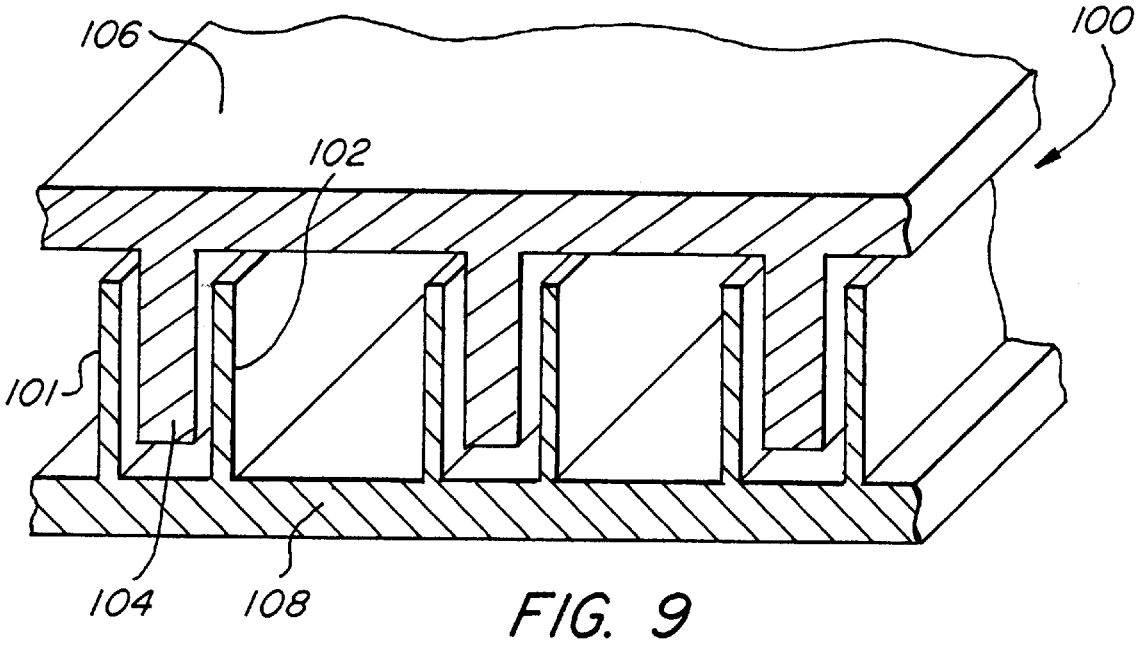
FIG. 9 is a side view of an embodiment of an electrostatic mechanically actuated fluid micro-metering device of the present invention, including a cap plate and a base.

In a further embodiment of the present invention shown in FIG. 9, the fluid micro-metering device 100 includes a cap plate 106 and a base 108 for receiving the cap plate 106. The base 108 has walls 101, 102 substantially parallel to base electrode 104 extending from the cap plate 106. The cap plate may function to seal the chambers, as well as to isolate the electrodes 104 from the walls 101, 102 and the chambers.

Figure 10:
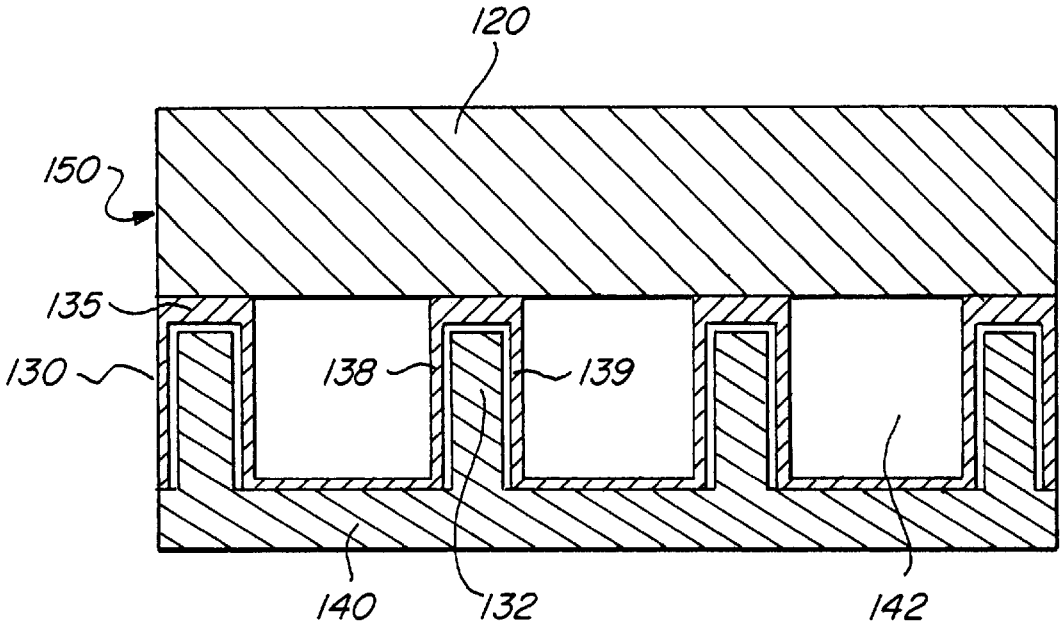
FIG. 10 is a side view of an embodiment of an electrostatic mechanically actuated fluid micro-metering device of the present invention, including a cap plate, an intermediate plate and a base.

In yet another embodiment of the present invention shown in FIG. 10, the fluid micro-metering device 150 may comprise the cap plate 120, an intermediate plate 130 for receiving the cap plate 120, and a base 140 for receiving the intermediate plate 130. The intermediate plate 130 can further comprise a plurality of walls 138 and 139, which form an array of chambers 142, wherein the structural material of the intermediate plate further comprises a bridge 135 joining walls 138, 139. As shown in FIG. 12, the base 140 is designed to receive the intermediate plate 130 wherein the base 140 has a plurality of electrodes 132 extending there from to fit between bridge 135 and walls 138, 139 of the intermediate plate 130. The electrodes 132 can electrostatically actuate walls 138, 139 as described previously. As with the other aspects of the present invention, the print head 150 is configured such that the axis of deformation of the membrane material for walls 138, 139 is substantially parallel to the width of chambers 142, causing fluid contained in the chambers to eject through the orifices. Such a deflection of walls 138, 139 created by a voltage applied to electrode 132 across the gap formed by the base electrode 132 and walls 138, 139 of the intermediate plate 130 is designed to create a pressure increase within an array of fluid or ink chambers, such as represented by ink chamber 142, to eject an fluid drop through fluid ejection orifices or nozzles.

It should be understood that the described aspects of present invention are not limited to a print head ejecting only ink, but may be applied to any fluid micro-metering device, wherein a fluid is ejected from a chamber through a chamber orifice by pressure changes within the chamber created by electrostatically actuated membranes.

Advantageously, the present invention has an integrated, modular design that is easy to manufacture. For example, the invented electrostatic mechanically actuated fluid micro-metering device may be batch fabricated from a single substrate, by methods readily allowing for the selection of materials having the appropriate stiffness (modulus of elasticity), conductivity or wetting characteristics for a particular application.

The above description is intended to enable the person skilled in the art to practice the invention. It is not intended to detail all possible modifications and variations which will become apparent to the skilled worker upon reading the description. It is intended, however, that all such modifications and variations be included within the scope of the invention which is defined by the following claims. The claims are meant to cover the indicated elements and steps in any arrangement or sequence which is effective to meet the objectives intended for the invention, unless the context specifically indicates the contrary.

What is claimed is:

1. An electrostatically actuated fluid micro-metering device, comprising:

a chamber having a pitch dependent on the chamber width; and at least one chamber wall comprising an electrostatically deformable membrane having a length and height, wherein the chamber pitch is independent of the length and height of the membrane.

2. A device according to claim 1, wherein the chamber pitch is at least about 50 microns.

3. A device according to claim 1, wherein the chamber pitch is at least about 25 microns.

4. A device according to claim 1, wherein a plurality of chambers are aligned in an array.

5. A device according to claim 1, wherein first and second chamber walls each comprise an electrostatically deformable membrane, and the first chamber wall is opposed to the second chamber wall.

6. A device according to claim 5, further comprising a base integral with the electrode and the chamber wall, the base forming the bottom wall of the chamber, wherein the base, chamber wall and electrode are formed from a single substrate.

7. A device according to claim 5, wherein a plurality of chambers are aligned in an array, and wherein the electrode electrostatically actuates a first membrane of a first chamber and a second membrane of a second adjacent chamber.

8. A device according to claim 5, further comprising an orifice in a chamber wall, such that an electrostatic force exerted across the electrostatic gap and between the electrode and the at least one chamber wall causes deformation of the membrane, whereby fluid within the chamber is ejected through the orifice.

9. A device according to claim 8, wherein the electrode, chamber wall and orifice are constructed and arranged so that the electrostatic force causes the first chamber wall to deform away from the second chamber wall in a direction normal to the ejection direction of the orifice.

10. A device according to claim 1, wherein an electrode is spaced from and adjacent to the at least one chamber wall, the electrode being opposed to the chamber, and wherein an electrostatic gap is defined between the electrode and the at least one chamber wall.

11. An electrostatically actuated fluid micro-metering device, comprising:

a chamber having a pitch dependent on the chamber width along the transverse axis of the chamber; and at least one chamber wall comprising an electrostatically deformable membrane having a deformation axis;

wherein the deformation axis of the membrane is substantially parallel to the transverse axis of the chamber.

12. A device according to claim 11, wherein the chamber pitch is at least about 25 microns.

13. A device according to claim 11, wherein a plurality of chambers are aligned in an array.

14. A device according to claim 13, wherein a plurality of chambers are aligned in an array, and wherein the electrode electrostatically actuates a first membrane of a first chamber and a second membrane of a second adjacent chamber.

15. A device according to claim 13, further comprising an orifice in a chamber wall, such that an electrostatic force exerted across the electrostatic gap and between the electrode and the at least one chamber wall causes deformation of the membrane, whereby fluid within the chamber is ejected through the orifice.

16. A device according to claim 15, wherein the electrode chamber wall and orifice are constructed and arranged so that the electrostatic force causes the chamber wall to deform parallel with the transverse axis of the chamber, to increase the volume of the chamber.

17. A device according to claim 11, wherein first and second chamber walls each comprise an electrostatically deformable membrane, and the first chamber wall is opposed to the second chamber wall.

18. A device according to claim 17, further comprising a base integral with the electrode and the chamber wall, the base forming the bottom wall of the chamber, wherein the base, chamber wall and electrode are formed from a single substrate.

19. A device according to claim 11, wherein an electrode is spaced from and adjacent to the at least one chamber wall, the electrode being opposed to the chamber, and wherein an electrostatic gap is defined between the electrode and the at least one chamber wall.

20. An electrostatically actuated fluid micro-metering device, comprising:

a substrate;

a chamber formed in the substrate, the chamber having a base and at least one chamber wall comprising a deformable membrane;

an electrode formed in the substrate spaced from and adjacent to the at least one chamber wall, the electrode being opposed to the chamber;

an electrostatic gap between the electrode and the at least one chamber wall;

means for exerting an electrostatic force between the membrane and the electrode; and an orifice plate having an orifice, the orifice plate defining the chamber top wall.

21. A device according to claim 20, wherein the micro-metering device is an ink jet print head.

22. A device according to claim 20, wherein a plurality of chambers are formed in the substrate, and wherein a single electrode electrostatically actuates a first chamber wall of a first chamber and a second chamber wall of a second adjacent chamber.

23. A electrostatic mechanically actuated ink jet print head comprising:

a base;

a plurality of walls extending from the base;

a bridge joining at least one pair of the plurality of walls; and a plurality of electrodes extending from the bridge; the walls having electrostatically deforming membranes with a deformation axis; the membranes extending substantially parallel to the electrodes thereby forming an array of ink chambers each having a width and length, the array having a pitch substantially determined by the width, wherein the deformation axis is substantially parallel to the width of the ink chambers.

24. A fluid ejection device, comprising:

a plurality of chambers aligned in a width direction, each chamber having a pair of side walls extending front to back in a direction normal to the width direction, and a front wall extending from the front of one side wall of each chamber to the front of the other side wall of said chamber and an orifice formed through the front wall, constructed to jet fluid through the front wall;

an electrode associated with at least one of the side walls of each chamber;

the side wall associated with the electrode being deformable and electrostatically attractable by the electrode, upon electrostatic activation of the electrode, in a direction parallel with the width direction, to increase the volume of the chamber.

* * * * *